US008196219B2

(12) United States Patent
Roeckl

(10) Patent No.: US 8,196,219 B2
(45) Date of Patent: Jun. 12, 2012

(54) GLOVE, IN PARTICULAR FOR BICYCLING

(76) Inventor: Stefan Roeckl, St.-Heinricher-Straβe 40 (DE)

( * ) Notice: Subject to any disclaimer, the term of this patent is extended or adjusted under 35 U.S.C. 154(b) by 0 days.

(21) Appl. No.: 12/375,935

(22) PCT Filed: Jul. 31, 2007

(86) PCT No.: PCT/EP2007/006770

§ 371 (c)(1),
(2), (4) Date: Apr. 1, 2009

(87) PCT Pub. No.: WO2008/014978

PCT Pub. Date: Feb. 7, 2008

(65) Prior Publication Data

US 2009/0307824 A1 Dec. 17, 2009

(30) Foreign Application Priority Data

Jul. 31, 2006 (DE) ..... 10 2006 035 615

(51) Int. Cl.
*A41D 13/08* (2006.01)
*A41D 19/00* (2006.01)

(52) U.S. Cl. ..... 2/16; 2/159; 2/160; 2/161.1; 2/164

(58) Field of Classification Search ..... None
See application file for complete search history.

(56) References Cited

U.S. PATENT DOCUMENTS 2,907,047 A * 10/1959 Steinberg ..... 2/161.3
3,296,626 A * 1/1967 Ludwikowski ..... 2/87
4,411,024 A * 10/1983 Hayes ..... 2/20
4,570,269 A * 2/1986 Berlese ..... 2/16
4,663,783 A * 5/1987 Obayashi ..... 2/161.1
4,757,555 A * 7/1988 Gold ..... 2/16
4,768,234 A * 9/1988 Yamamoto ..... 2/16
4,846,843 A * 7/1989 Gammer ..... 623/57
4,864,659 A * 9/1989 Morris ..... 2/20
4,942,626 A * 7/1990 Stern et al. ..... 2/161.7
5,079,776 A * 1/1992 Crawford ..... 2/20
5,187,815 A * 2/1993 Stern et al. ..... 2/16
5,435,007 A * 7/1995 Kalvestran et al. ..... 2/16
5,640,712 A * 6/1997 Hansen et al. ..... 2/20
5,787,506 A * 8/1998 Wilder et al. ..... 2/161.1
5,898,938 A * 5/1999 Baylor et al. ..... 2/20
5,920,908 A * 7/1999 Widdemer ..... 2/161.2
5,946,720 A * 9/1999 Sauriol ..... 2/16
6,065,155 A * 5/2000 Sandusky ..... 2/161.1
6,105,162 A * 8/2000 Douglas et al. ..... 2/20
6,122,769 A * 9/2000 Wilder et al. ..... 2/16
6,171,431 B1 * 1/2001 Gallagher et al. ..... 156/251
6,253,382 B1 * 7/2001 Kleinert ..... 2/161.1
6,708,582 B1 * 3/2004 McJunkin et al. ..... 74/488
6,715,152 B2 * 4/2004 Mazzarolo ..... 2/161.6
6,845,519 B2 * 1/2005 Garneau ..... 2/161.1
7,254,840 B2 * 8/2007 Hammons et al. ..... 2/16
(Continued)

FOREIGN PATENT DOCUMENTS

WO WO 2006/068381 1/2006

*Primary Examiner* — Bobby Muromoto, Jr.
(74) *Attorney, Agent, or Firm* — MH2 Technology Law Group LLP

(57) ABSTRACT

Gloves, in particular cycling gloves, are being furnished which allow an efficient circulation of air in the interior of the glove in the area of the palm and largely prevent the development of sweat on the user's hand.

23 Claims, 2 Drawing Sheets

U.S. PATENT DOCUMENTS

| | | | | |
|---|---|---|---|---|
| 7,578,006 | B2 * | 8/2009 | Garneau | 2/161.1 |
| 7,669,251 | B2 * | 3/2010 | Hammons et al. | 2/161.1 |
| 7,707,653 | B2 * | 5/2010 | Kleinert | 2/161.1 |
| 2005/0066412 | A1 * | 3/2005 | Morrow | 2/161.1 |
| 2005/0114981 | A1 * | 6/2005 | Shim et al. | 2/159 |
| 2006/0143767 | A1 * | 7/2006 | Yang et al. | 2/16 |
| 2006/0195967 | A1 * | 9/2006 | Kohler | 2/161.1 |
| 2006/0195968 | A1 * | 9/2006 | Powell et al. | 2/161.1 |
| 2007/0113317 | A1 * | 5/2007 | Garneau | 2/161.1 |
| 2008/0110291 | A1 * | 5/2008 | Vitek | 74/551.9 |
| 2008/0119700 | A1 * | 5/2008 | DeGould | 600/323 |
| 2009/0307824 | A1 * | 12/2009 | Roeckl | 2/161.1 |

* cited by examiner

GLOVE, IN PARTICULAR FOR BICYCLING

This application is a U.S. National Stage application of PCT/EP2007/006770, filed 31 Jul. 2007, which claims priority to German patent application DE 10 2006 035 615.2, the entire disclosures of both of which are hereby incorporated herein by reference in their entireties.

The invention concerns a glove, in particular a sports glove for summer sports such as cycling.

The like priorly known gloves, in particular for the practice of active sports such as, e.g., cycling or Nordic Walking, are typically provided with substrate materials that prevent slipping and provide a secure grip, to thus prevent the risk of dropping the sports article or even losing the glove during practice of the sport. Thus, the internal part of the glove typically has a material layer on the glove's exterior side which imparts a particularly secure grip, so that the respective sporting equipment remains safely in the hand or—for instance in the case of a bicycle or motorcycle handle—may be controlled safely. Furthermore such gloves frequently have materials such as terry cloth, fleece in the area of the palm and are often additionally padded so as to furnish a certain degree of ergonomy during practice of the sport, e.g., in cycling. Particularly in the field of sports involving prolonged resting on or grasping of a handle, a particular degree of padding is advantageous, for example in order to avoid a carpal tunnel syndrome, but also for the event of a fall. Frequently used padding materials are gel, foam (expanded materials) or silicone coatings.

The additional material layers or padding areas described in the foregoing do, however, present the drawback of poor climate control in warm temperatures, for example during the summer months. Thus, a temperature equalization between the user's hand accommodated inside the glove and the environment is hampered by the insulating effect of one or more additional layers of material and by the material used. This is true for the case of bicycle and motorcycle gloves, in particular for the inner hand area of the palm whereby the handlebar is grasped, so that hardly any air or draft and running wind is allowed to reach the skin in the area of the palm even if air-permeable material is used for the inside of the glove, or even when the hand is bare. Accordingly, overheating of the hand and an associated development of sweat may occur locally in this area on the inside of the hand, whereby not only the wearing comfort is impaired but in addition the athlete's performance may be deteriorated. Particularly with sports such as cycling, motorcycle riding and moto-cross a sweaty inner hand, especially with the use of silicone as an additional material layer, may become particularly slippery to thus give rise to potential risks.

In view of the problems inherent in the prior art, the present invention is based on the object of creating a glove of the type specified at the outset, where an efficient circulation of air in the interior of the glove in the area of the palm is made possible, and thus the development of sweat on the user's hand is largely avoided or carried off by the draft, respectively, resulting in a considerable improvement of wearing comfort and safety.

In accordance with the invention, this object is achieved by a development of the glove of the type specified at the outset, which is essentially characterized in that the material layer of the inside of the glove includes passage elements or air flow conduits, such as tubes, which allow air to pass from the glove's upper side, preferably through funnels in the area between the knuckles of the base of the fingers at the inner surface of the hand in the area of the palm.

Accordingly, the present invention concerns a glove, preferably a cycling glove, having finger parts and a padding of the glove's inside, with a stream of air being allowed to pass from the glove's upper side via passage elements to the inner surface of the hand.

The configuration of the invention allows in a surprisingly simple manner an effective exchange of air on the inner side of the hand to thus counteract the development of sweat at the palm and thereby furnish a noticeable enhancement of the wearing comfort. One particular advantage of the glove of the invention is that in accordance with the invention, padding elements for forming or receiving the passage elements are employed which at the same time permit an improved protection against pressure marks for the hand area corresponding to the transition from the metacarpal bone to the base finger joints frequently experiencing the formation of calluses, in the following referred to as callus-prone area.

The glove of the invention thus at the same time attends to several requirements of athletes, in particular cyclists, for on the one hand it suppresses an unpleasant development of sweat that is even undesirable under safety aspects in certain sports, and furthermore furnishes in the sensible areas of the inner hand a padding that counteracts local pressure strains, for example when gripping a handlebar.

In particular among hobby athletes who refuse to wear sports gloves owing to the bothersome development of sweat, this is suited to further the preparedness for wearing sports gloves for protecting their hands and due to the above-mentioned general safety aspects.

The invention shall in the following be explained in more detail by referring to a practical example that is represented in the drawings.

Embodiments of the subject matter of invention are explained with the aid of the drawings, wherein.

Figure 1:
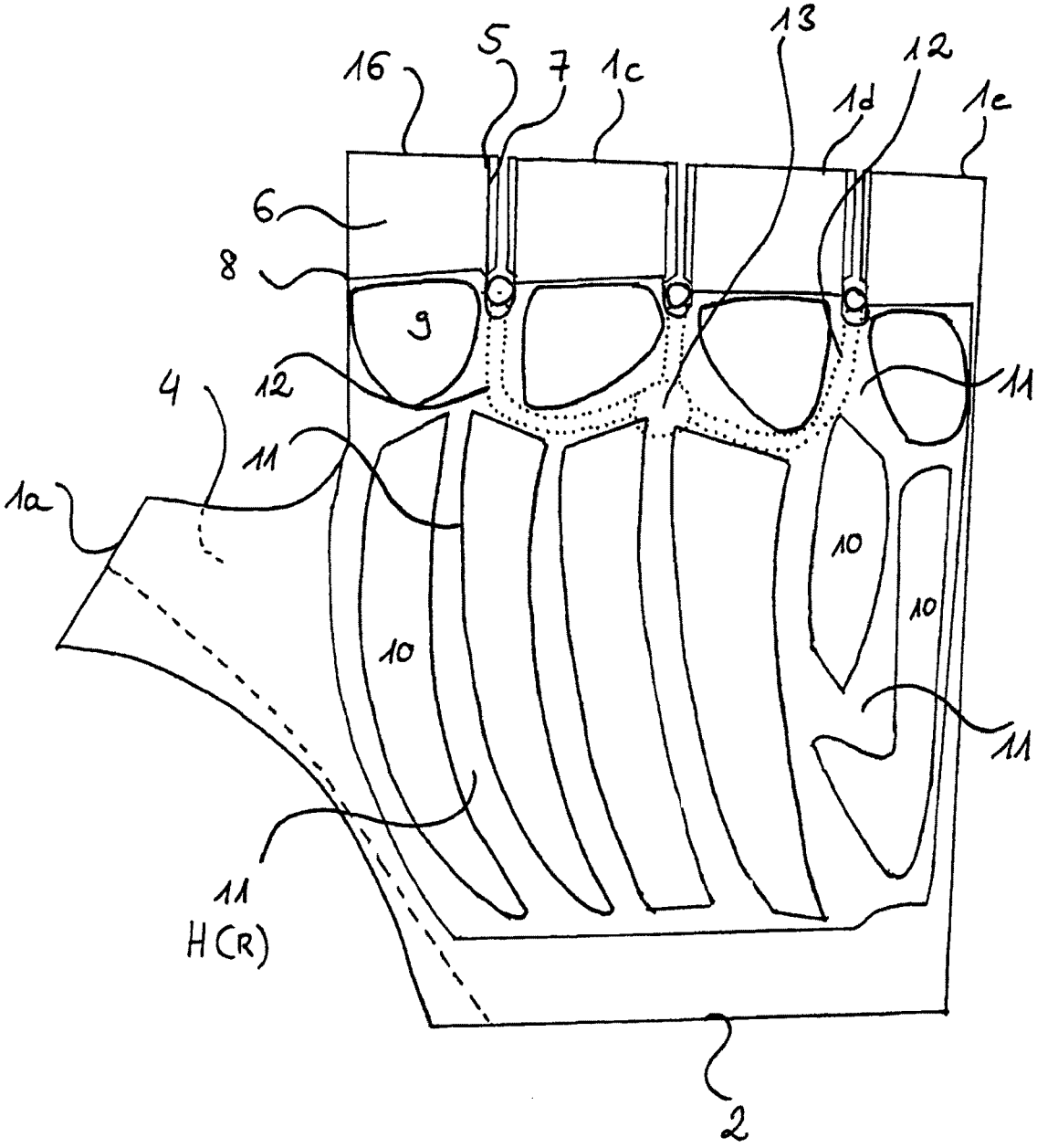
FIG. 1 is an inside-out view of a glove from the side of the palm.
Figure 2:
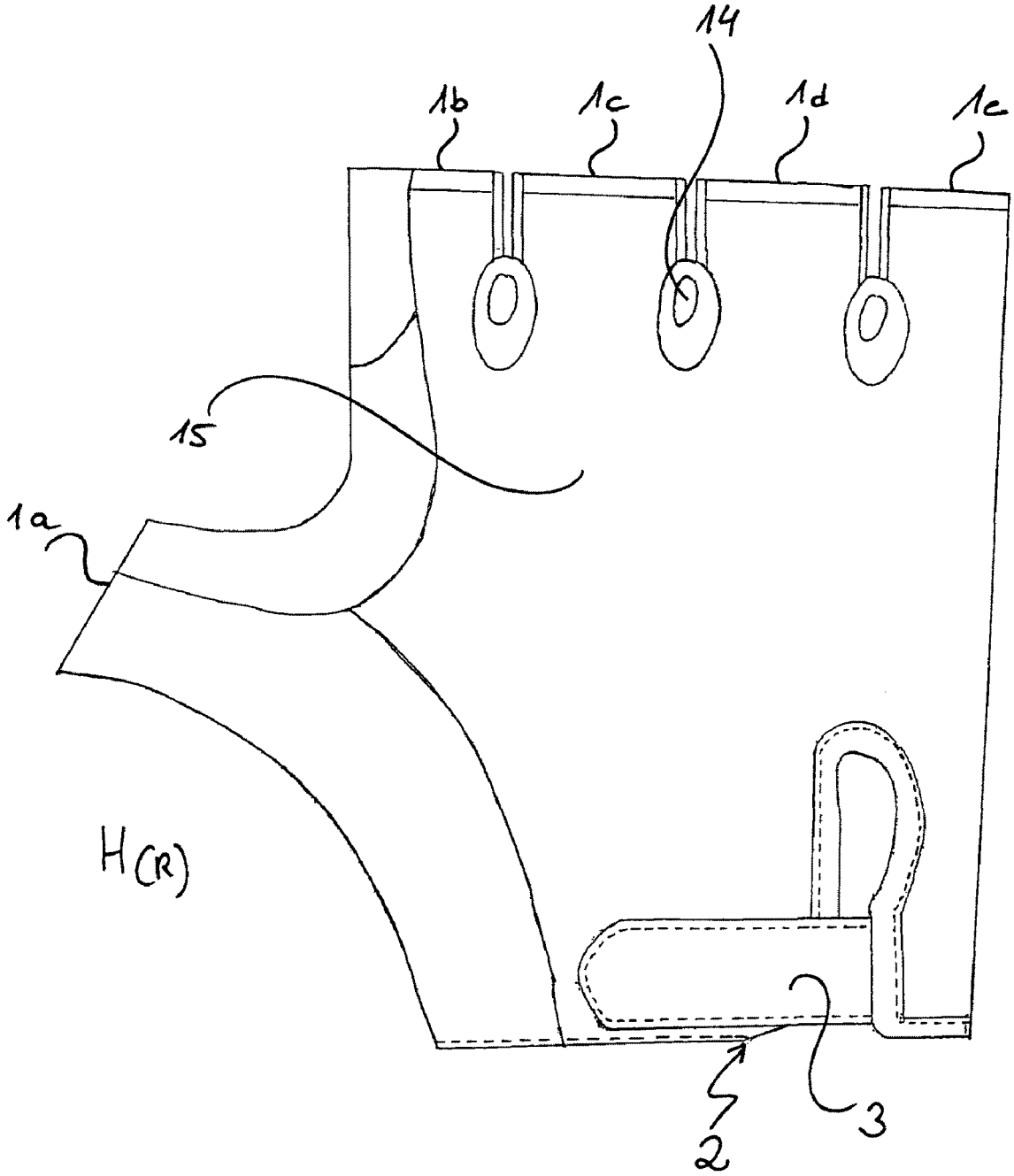
FIG. 2 is a view of a glove from the side of the back of the hand.

FIGS. 1 and 2 show a first practical example of a glove of the invention, with the inside being represented turned outside in FIG. 1. In the represented practical example, the glove has the form of a half-finger cycling glove. A glove H(R) for the right hand, in particular a bicycle or sports glove, with half-fingers 1*a* (for the thumb) and 1*b* to 1*e* (for the remaining fingers) has a hand insertion opening 2 with or without a closure, in the present case, e.g., a Velcro closure 3, and in the area of the palm, e.g., a covering 4 for enhancing the grip that is not represented in FIG. 1. Every half-finger 1*b* to 1*e* may be manufactured of single fashioned parts 6, 7 connected by stitched connections 5, such as to have on the inner and outer sides of the fingers and in the interstices between the fingers, for example, various materials, seam lines, or fabrics (layers) that are adapted to the respective demands and contribute to good wearing comfort. Every half-finger 1*b* to 1*e* has a schematically represented finger base 8.

In the area of the schematically represented finger base, passage elements 11 on the inner side of the glove conduct air to the palm, wherein the external air passes via an inlet 14 into the passage elements 11 located in this practical example between the finger parts 1*b*, 1*c*, 1*d*, 1*e* at the finger knuckles of the upper hand 15. In the case of another practical example not represented here, the inlets may optionally be provided in the form of a slit above the connection between thumb and index finger, for example in the case of a racing handlebar posture in order to here, as well, catch the running wind in an optimum manner, for here air does not flow in via the knuckles. The passage elements may be formed by the paddings 9, 10 and/or include—as indicated in dashed line—conduits 12 having the form of tubes. The air flow conduits 12 are preferably replaceable, so that for instance in the case of obstructions the conduits may easily be cleaned or exchanged. As is shown in FIG. 1 and FIG. 2, the air is introduced into the passage elements or conduits via air inlets disposed in the area of the root of the half-fingers 1*b* to 1*e* on the glove's upper side. The air inlets 14 exemplarily having the form of nozzles may, e.g., be integrated into the layers that are disposed between the fingers, i.e., from the index finger 1*b* to the little finger 1*e* at the finger base 8 on the upper hand. The air inlets 14 in a given case include a membrane which prevents the penetration of humidity and/or foreign materials, such as dust or pollen, to the interior of the glove. In another embodiment presently not represented, the air inlets are preferably adapted to be closed so as to maintain the enhanced wearing comfort in cases, e.g., of rain or extremely cold air.

The inlets 14 are preferably comprised of synthetic material and are inserted or applied in the material layer of the upper hand in the respective area of the finger base between the fingers 1*b* to 1*e* and affixed, e.g., by a stitched connection. When the air inlets are disposed in the area between the knuckles and base of the fingers 1*b*, 1*c*, 1*d*, 1*e*, they have the least negative effect on the functionality of the glove while also hardly impairing either the wearing comfort or the esthetic impression of the glove. On the contrary it is possible to achieve an altogether esthetically appealing and sportive, or technical or futuristic appearance of the glove by using attractively designed nozzles.

On the hand inner side 2 the paddings 9, 10 of conventional padding materials such as foam, gel, latex, rubber or mixtures or combinations of these are disposed, wherein the one part of the padding 9 that pads the "callus"-prone area of the inner hand may be downwardly extended in an area 10 into the palm and disposed as far as to the wrist, as may particularly be taken from FIG. 1. The paddings 9, 10 may be disposed on the glove's inside and optionally be covered by a lining having the size of the padding material or by a complete glove lining.

The size and configuration of the paddings 9 that are disposed at the "callus"-prone areas, or 10 that extend across the palm, should be configured such that on the one hand the paddings 9, 10 are in any gripping position located between the wearer's hand and the handle, and on the other hand the passage elements 11 reach as far as the end of the palm. In a preferred manner the paddings 9, 10 and the passage elements extend to a short distance in front of the termination of the glove at the wrist. In order to avoid a possible backup of air, air exit openings or preferably a highly air-permeable material may be provided in another embodiment that is presently not represented.

In FIG. 1 the passage elements 11 are formed as conduits having the form of tubes 12 which open, below the padding of the "callus"-prone area, into an outlet 13 from which the air may directly pass to the various regions of the palm. Although preferred, the use of such conduits is not forcibly necessary. Instead, the passage elements formed by the paddings 9, 10 may also be utilized for directly conducting the air to the palm of the hand. Nevertheless the use of tubes ensures that the supply of running wind will not be interrupted even by firmly encircling the sports equipment such as the handlebar, thereby "nipping" the stream of air in the callus-prone area. Here it should be understood that the passage elements, which are represented open in FIG. 1, may also be partly closed starting from the air inlet or are also entirely enclosed by a material layer which is either perforated or in itself at least partly air-permeable, so that the air introduced into the passage elements may thus reach the palm with maximum homogeneity. When using functional material, the running wind felt at the inner hand in the area of the passage elements might even maximize the evaporative cooling of sweat.

In another embodiment presently not represented, the structure of the air passages includes a preferably branching air passage design in the area of the inner surface of the hand. It should be understood that in the case of a branching air passage design, which allows an even more homogeneous ventilation of the inner surface of the hand, correspondingly firm padding material is used in order to prevent "squashing" of the branching network and concurrent nipping of the air supply.

In another embodiment, the area between the callus-prone area of the hand is provided with the branching air channel design and correspondingly hard padding material as far as approximately to the upper area of the heel of the hand, which corresponds to the location of the pressure strain when firmly encircling the handlebar, whereas the area from the upper heel of the hand as far as the wrist (hand insertion opening of the glove) comprises three-dimensional mesh material, wherein the paddings (10) and the passage elements (11) open into the three-dimensional mesh material. In a preferred manner, this embodiment further comprises a further abrasion-resistant or slip-preventing material layer. In a practical example, the latter comprises an air-impermeable material, so that a clear flow towards the wrist is provided for the air escaping via the filters, and the air only exits after completely flowing through the inner hand. In accordance with the invention it is, of course, also possible to use combinations of the above-described embodiments, for example an open passage element emerging between the finger parts 1*b* and 1*c* and two conduits emerging from the air inlet at the finger parts 1*c*, 1*d*, 1*e*, and other combinations.

Basically it is also possible to configure the glove of the invention as a mitten and arrange the air inlet at the corresponding locations on the upper hand. In accordance with the invention, however, sports gloves having finger parts are preferred embodiments. In other embodiments the sports glove may, of course, also comprise half-fingers.

The inner and upper hand parts of the glove are comprised of material that is customary for the gloves mentioned at the outset, for example textile material. In the case of a summer sports glove, e.g., a summer cycling glove, the upper hand part is comprised of knitted fabric, Lycra, Micromesh or Macromesh. In the case of a motorcycle or moto-cross glove, for example, the upper hand part is comprised of woven or leather material, such as suede or synthetic leather. As suede or synthetic leather, but also other woven materials that are not comprised of leather possess a high degree of suppleness, flexing of the fingers in the area between palm and finger portion is facilitated if the areas of the transition between the area of the palm and the respective finger areas of the inner hand part are comprised of such a material or combinations of these. Furthermore, in one embodiment, for example in a motorcycle or moto-cross glove, the air may also be conducted to the upper hand. In an expedient embodiment for cycling gloves in accordance with the invention, the material layer of the glove's upper side is comprised of particularly air-permeable "mesh" material. However it is also possible to use other textile materials as well as leather, leather imitation, or synthetic leather.

From the above discussion it is evident that the glove of the invention may be utilized in a multiplicity of sports, for example as a cycling glove, motorcycle glove, moto-cross glove, cross-country skiing glove, snowmobiling glove, downhill skiing glove, golf glove, tennis glove, goalkeeper's glove, fitness glove, or a glove for Nordic Walking, badminton, baseball, archery, weightlifting, or practitioners of shooting sports. It is, however, also possible to use a glove in accordance with the invention for warm spring days.

LIST OF REFERENCE NUMERALS

1*a*) half-finger part for thumb
1*b*) half-finger part for index finger
1*c*) half-finger part for middle finger
1*d*) half-finger part for ring finger
1*e*) half-finger part for little finger
2) hand insertion opening (slip-on opening)
3) Velcro closure
4) covering
5) stitched connections
6) fashioned part
7) fashioned part
8) finger base
9) padding
10) padding
11) passage elements
12) air flow conduit
13) outlet
14) inlet
15) upper hand

The invention claimed is:

1. A glove having finger parts, paddings on the glove's inside, one or more inlets on the exterior of the glove, and one or more openings or outlet valves on the inner side of the glove, wherein the paddings on the glove's inside form a framework for one or more air channels, wherein the one or more air channels that are disposed within the framework formed by the paddings on the glove's inside commence at the one or more inlets and extend through the palm of the glove to the one or more openings or outlet valves, such that external air from the upper side of the glove may pass into the air channels via the one or more inlets, allowing a stream of air from the upper side of the glove to pass through the air channels to the one or more openings or outlet valves on the inner surface of the hand.

2. The glove according to claim 1, further comprising tubing disposed within the one ore more air channels.

3. The glove according to claim 2, wherein the one or more air channels includes an air channel extending from each of the interstices between the fingers and the tubing is interconnected and extends from the one or more inlets through the air channels extending from each of the interstices between the fingers, opening into one or more outlets on the inner side of the glove.

4. The glove according to claim 1, wherein the paddings are provided only partially.

5. A glove having finger parts, paddings on the glove's inside, one or more inlets on the exterior of the glove, and one or more openings or outlet valves on the inner side of the glove, wherein the paddings on the glove's inside form a framework for one or more air channels, wherein the one or more air channels that are disposed within the framework formed by the paddings on the glove's inside commence at the one or more inlets and extend through the palm of the glove to the one or more openings or outlet valves, such that external air from the upper side of the glove may pass into the air channels via the one or more inlets, allowing a stream of air from the upper side of the glove to pass through the air channels to the one or more openings or outlet valves on the inner surface of the hand;

wherein the one or more inlets comprise a first inlet located between the index finger and the middle finger of the upper hand, a second inlet located between the middle finger and the ring finger of the upper hand, and a third inlet located between the ring finger and the pinky finger of the upper hand; and wherein the paddings on the glove's inside are disposed in the area of the palm, with a first pad at the base of the index finger, a second pad at the base of the middle finger, a third pad at the base of the ring finger and a fourth pad at the base of the pinky finger, such that the first pad and the second pad form a first air channel extending from the first inlet to one or more openings or outlet valves on the inner surface of the hand, the second pad and the third pad form a second air channel extending from the second inlet to one or more openings or outlet valves on the inner surface of the hand, and the third pad and the fourth pad form a third air channel extending from the third inlet to one or more openings or outlet valves on the inner surface of the hand.

6. The glove according to claim 1, wherein the paddings include a foam, gel, latex or rubber material, or a mixture or combination of these.

7. The glove according to claim 1, wherein the paddings are covered by a lining material.

8. The glove according to claim 7, wherein the lining material includes a functional material.

9. The glove according to claim 1, wherein the external air passes into the one or more air channels via the one or more inlets located between the finger parts at the finger knuckles of the upper hand.

10. The glove according to claim 9, wherein the one or more inlets outwardly has the form of a funnel.

11. The glove according to claim 9, wherein the one or more inlets has the form of a nozzle.

12. The glove according to claim 9, wherein the one or more inlets is inserted or applied in the material layer in the external side of the glove.

13. The glove according to claim 12, wherein the one or more inlets is inserted or applied by stitched connection or stitchless connection (bonding) or includes a previously connected part of a glove part.

14. The glove according to claim 9, wherein the one or more inlets is substantially comprised of synthetic material.

15. The glove according claim 9, wherein the one or more inlets is adapted to be closed or comprises a membrane for preventing the penetration of humidity to the interior of the glove.

16. The glove according to claim 1, wherein the finger parts are half-fingers.

17. The glove according to claim 1, wherein the upper hand substantially comprises an air-permeable material.

18. The glove according to claim 17, wherein the air-permeable material comprises mesh material.

19. The glove according to claim 2, wherein the tubing is replaceable.

20. The glove of claim 5, further comprising tubing disposed within the first, second, and third air channel.

21. The glove of claim 1, wherein the one or more air channels includes an air channel extending from each of the interstices between the fingers.

22. The glove of claim 5, further comprising longitudinal padding members disposed under each of the first, second, third, and fourth pad, wherein the longitudinal padding members extend across the palm.

23. The glove of claim 1, wherein the one or more inlets are located above the connection between the thumb and index finger.

* * * * *